United States Patent [19]

Ryan

[11] Patent Number: 4,958,397

[45] Date of Patent: Sep. 25, 1990

[54] POWER RAIN GUTTER CLEANING TOOL

[76] Inventor: Timothy J. Ryan, 3201 Carmel Rd., Charlotte, N.C. 28226

[21] Appl. No.: 294,686

[22] Filed: Jan. 9, 1989

[51] Int. Cl.[5] ..... A47L 25/00; A46B 13/02

[52] U.S. Cl. ..... 15/93.1; 15/3; 15/23; 15/92

[58] Field of Search ..... 15/23, 24, 92, 97, 93 R, 15/3

[56] References Cited

U.S. PATENT DOCUMENTS 3,751,749 8/1973 Wilson ..... 15/92

4,238,866 12/1980 Taylor ..... 15/23

*Primary Examiner*—Edward L. Roberts

[57] ABSTRACT

A power apparatus for cleaning pine needles and other debris from overhead rain gutters while operated by an individual who is standing on the ground. A disk with protruding plastic apikes is attached to a gear assembly and electric motor. The disk rotates and throws debris from the gutter. A guard prevents said thrown debris from landing on the roof. The electric motor and gear assembly are located inside a housing which is at one end of a crossarm. A guide, fitting underneath said housing, can be adjusted to provide the proper amount of contact between the disk and debris laying in the bottom interior of the gutter. At the opposite end of said crossarm to the housing is a dislodge blade used to shift debris which may be unreachable by said disk especially debris located directly beneath gutter hangers. The dislodge blade is used to push this debris to a more accessible area of the gutter where the, disk is then used. The crossarm is connected to an extendible pole which permits use of the apparatus with gutters of various heights. Controls for the motor are located in the pole handle. The apparatus can be partially disassembled for easy shipment and storage.

6 Claims, 6 Drawing Sheets

POWER RAIN GUTTER CLEANING TOOL

BACKGROUND OF THE INVENTION

1. Field of the Invention

This invention pertains to an apparatus for cleaning pine needles and other debris from overhead rain gutters and, more particularly, to the types of gutter cleaners which are hand held and operated by an individual while standing on the ground.

Gutters and downspouts are used on buildings to direct rainwater runoff from the roof. Without a gutter, this rainwater would fall directly to the ground beneath the edge of the roof causing ditches or eroded areas. Gutters and downspouts instead channel the rainwater coming off of a roof to a selected discharge location.

A common difficulty with gutters is their tendancy to become clogged with pine needles, leaves, twigs and other debris. Such debris falls from nearby trees onto the roof and is then carried by rainwater into the gutter. Here some debris may tend to collect rather than be flushed by the waterstream down the downspout. Pine needles, due to their length, width and weight characteristics, are particularly disposed to layer themselves into an interwoven mat inside the gutter rather than flowing out the downspout.

With sufficient debris in the gutter, rainwater will begin to dam up in the gutter, overflow, and start to cause the erosion problems indicated earlier. Moreover, the debris can lead to insect infestation, may make the gutter unsightly, and may lead to premature weathering of the gutter.

2. State of the Prior Art

Several prior art devices have been offered which permit an operator who is on the ground to clean overhead gutters. Some of these previous devices utilize a claw mechanism which is attached to the top of a pole. The claw mechanism is entered into the gutter from above, the claws are clamped onto the debris, the mechanism is lifted, and then the debris is dropped to the ground. The operator removes debris bite by bite along the length of the gutter. Great strength and coordination is required to operate these devices particularly if cleaning a second story gutter which has a heavy load of pine needles because the pole must be held in one hand while the controlling rope to the claw mechanism is pulled with the other hand and also because the operator is manually both breaking up the mat of pine needles and lifting debris out of the gutter.

Other previous devices utilize a scoop attached at the top of a pole. The scoop is slid along the bottom interior of the gutter causing debris to be tilled over the edge of the gutter. Such devices are tiring to operate because the debris is removed manually from the gutter. Moreover, when cleaning a heavy mat of pine needles from a second story gutter, the pole carrying the scoop will either bend, vibrate uncontrollably or else will be of such heavy construction as to make the device unwiedly.

One previous device utilizes an electric motor at the top of a pole. The motor drives three flexible flaps which strike at the debris in the gutter. These flaps are felt to be inadequate to break up a heavy concentration of debris such as matted pine needles as the flaps will tend to ride up and on top of the mat rather than breaking it up. It is also felt that this device is heavy and would be awkward to operate especially at a second story elevation. The device does not appear to adequately safeguard against any debris which may be loosened by the flaps from being thrown onto the roof. The device seems incapable of removing debris unreachable by the flaps such as would be found directly underneath the gutter hangers.

Given this discussion of the prior art, it is therefore an objective of this invention to allow the action of the the electric motor driving the disk to remove debris from the gutter rather than the manual exertions of the operator.

It is therefore an objective of this invention to be operated while being held with both hands.

It is therefore an objective of this invention to utilize lightweight components and materials to permit easy and controlled use.

It is therefore an objective of this invention to guide debris which is thrown off by the rotating disk away from the roof and onto the ground.

It is therefore an objective of this invention to dislodge debris which may be located directly beneath gutter hangers to allow subsequent removal by the disk.

Other problems are associated with current gutter cleaning devices. Some current devices are largely of metal construction. However, as most gutters have painted metal surfaces, these devices may cause scratches. Therefore, it is an objective of this invention to utilize plastic materials wherever the device will be in contact with the gutter.

Some current gutter cleaning devices require pulleys, cables, springs or rollers and are consequently difficult to manufacture. Therefore it is an objective of this invention to be simple to manufacture.

Some current gutter cleaning devices are long and angular and therefore are difficult to ship and store. Therefore it is an objective of this invention to be readily disassembled for shipment and storage.

SUMMARY

To achieve these and other objectives, the present invention provides an apparatus for cleaning pine needles and other debris from overhead gutters wherein the apparatus comprises in general an extendible pole held by the operator while he is on the ground. The operator can adjust the length of the pole thereby allowing the apparatus to be used on gutters of various heights.

A handle, attached to the lower section of the pole, contains the on/off switch and clockwise/counterclockwise switch for the electric motor thereby permitting the operator to control the apparatus.

At the top of the pole a crossarm extends perpendicularly to the pole. Near one end said crossarm bends approximately 70 degrees towards the ground and is flattened into a rectangularly shaped dislodge blade. Said dislodge blade is manipulated by the operator to push debris which may be directly beneath gutter hangers a few inches along the inside of the gutter until said debris can subsequently be reached by the disk.

At the opposite end of the crossarm to said dislodge blade is the housing which contains an electric motor, shafts, gears and, extending in a straight line parallel to the horizontal section of the crossarm, a front shaft to which the disk is attached such that said disk is at right angles to said front shaft. Said disk is comprised of a thin, stiff, circular body from which, along the outer circumference, numerous semi-rigid polypropylene spikes extend parallel to said disk and, additionally, along the housing side and fence side of said disk, at the circumference, a few spikes extend perpendicularly to said disk.

The electric motor, via the gears and shafts, rotates said disk at high speed with the spikes breaking up the mat of interwoven pine needles and flinging the debris out of the gutter. The operator does not manually remove said debris out of the gutter, but instead positions the apparatus to allow the rotating disk to do the cleaning while the operator holds the pole with both hands.

The guard consists of a bracket attaching to the front panel of the housing and extending up and over the disk where said bracket joins to a half-circle shaped fence section. The apex of said fence section is at the top and the horizon is at the bottom. Said fence section is basically parallel to the disk except that along the circumference and approximately 2 inches towards the center, said fence is bent approximately 20 degrees towards the housing. Said guard fits over the top half of the disk such that debris thrown out of the gutter by the disk is directed away from the roof.

The guide consists of a plastic sheet with a "U" shaped cross section which is attached to the bottom of the housing with the bottom of the guide parallel to the bottom of the housing. The operator, by adjusting the bolts fastening the sides of the guide to the sides of the housing, varies the spacing between the bottom of the housing relative to the bottom of the guide. Since the bottom of the guide slides along the top outer wall of the gutter, this adjustment permits the operator to provide the proper contact between the disk and debris laying in the interior bottom of the gutter.

Construction of the current invention is of lightweight plastic and aluminum. Any point of contact between the device and the gutter is made of non-marring plastic. The device is easy to manufacture and fabricate.

By disconnecting the interior pole wires from the electric motor wires, detaching the crossarm from the upper pole section, and by telescoping the upper pole section into the lower pole section, the current invention can be easily transported and stored.

BRIEF DESCRIPTION OF THE DRAWINGS

The accompanying drawings illustrate an example of the preferred embodiment of the invention and, together with the description, serve to explain in principal the invention, wherein.

DETAILED DESCRIPTION OF THE DRAWINGS

Figure 1:
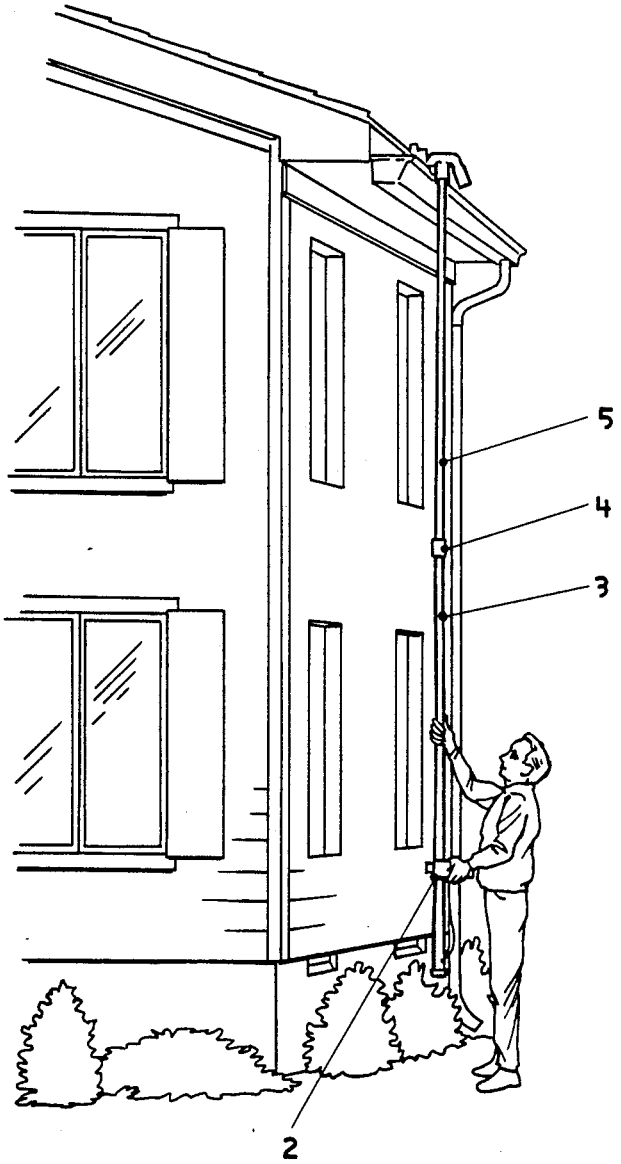
FIG. 1 is a view of the apparatus with an operator standing at ground level with the pole extended to a second story gutter.
Figure 1A:
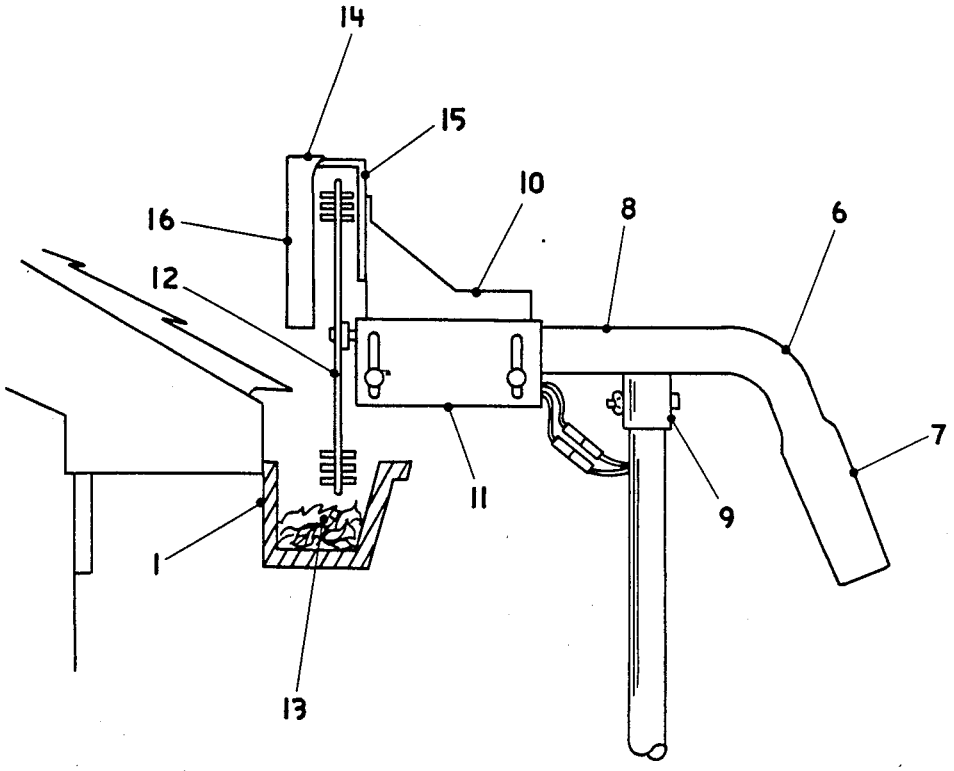
FIG. 1*a* is a perspective view of the gutter cleaning tool shown in FIG. 1.

Referring in detail to FIG. 1, a two story home is illustrated with a rain gutter (1) attached to the roof such that said gutter underhangs the roof and allows rainwater runoff to enter the gutter. The operator grasps the pole handle (2) with one hand and the lower pole section (3) with the other hand. The height of the pole has been adjusted by manipulating the threaded sqeeze fit coupling (4) to correctly position the upper pole section (5) which telescopes into said lower pole section. The crossarm, shown in general by (6) consists of a dislodge blade (7), horizontal section (8), connector (9), and housing (10). The guide (11) is attached to the bottom portion of the housing and said guide rests on the top of the outer wall of the gutter such that the disk (12) properly strikes the debris (13) within the gutter. The guard, shown in general by (14) consists of a bracket (15) and a fence (16) section. Said guard prevents debris which is thrown by the disk from landing on the roof.

Figure 2:
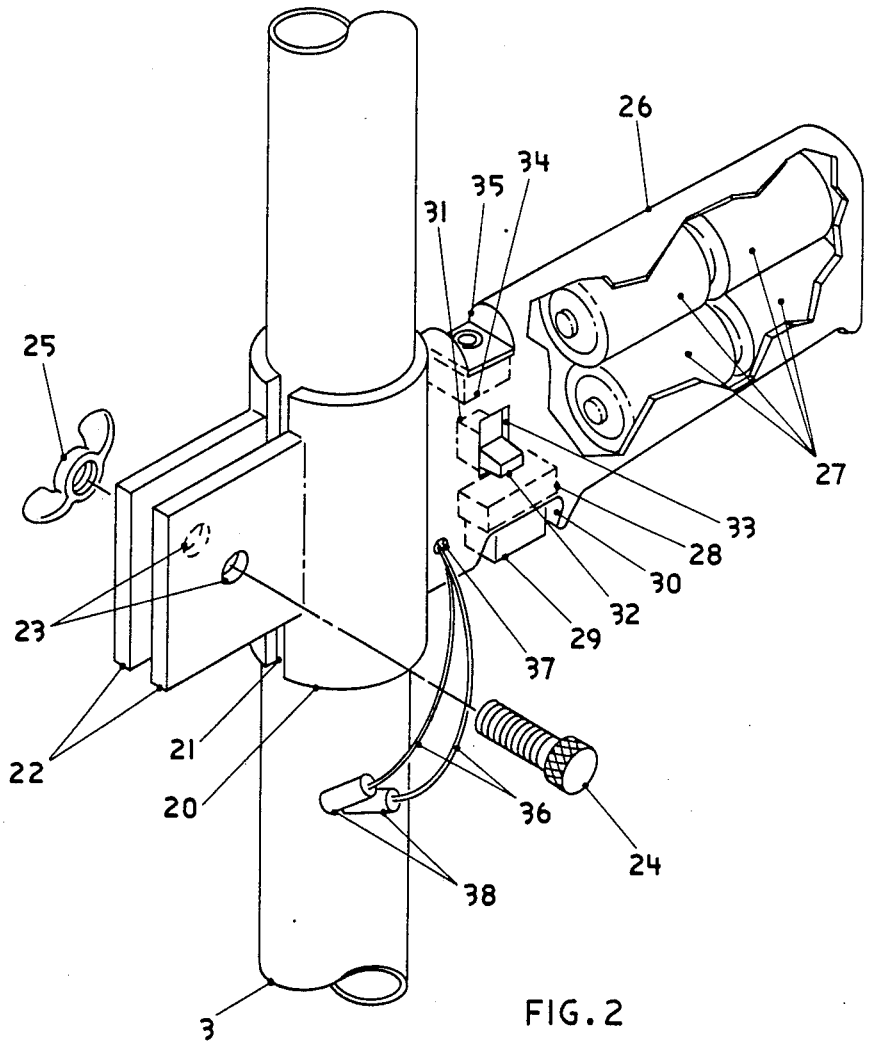
FIG. 2 is a side perspective of the pole handle showing a fragmentary view of the lower pole section and outlining certain parts in the interior of the handle.

In reference to FIG. 2 the pole handle is illustrated with the vertical section (20) consisting of a flexible thin-walled tube-like section whose inside radius is very slightly larger than the outside diameter of the lower section of the extendible pole (3). Said vertical section is split vertically such that a slight gap (21) exists between the near and far sides of said vertical section.

Tabs (22) extend from the near and far sides of the vertical section from the edge of said gap with each tab perpendicular to said lower pole section. A hole (23) is drilled through the tabs such that a knurled head thumbscrew (24) can be passed through said tabs into a wingnut (25). Said thumbscrew and wingnut, when tightened, will pull the opposing tabs together and cause the vertical tube-like section to bind against the lower pole section at a desired location.

Extending perpendicularly to said vertical portion, the horizontal portion (26) of said pole handle consists of an elliptically shaped cylinder of thin walled plastic closed at the end opposite to the pole. Inside the cylinder, running lengthwise from the closed end to the pole end, four nickel cadium rechargeable batteries (27) are set lengthwise in rows of two with the rows one on top of the other in parallel. At the bottom of the horizontal section near the edge with the vertical portion a spring loaded switch (28), which turns the motor on and off, is nestled inside of the cylinder. A plastic trigger (29) protrudes from this switch out through a rectangular opening (30) in the body wall of the cylinder. On the near side of the cylinder, near said vertical section, a toggle switch (31), which controls the clockwise/counterclockwise rotation of the motor, is nestled inside the cylinder. A plastic trigger (32) protrudes from said toggle switch through a rectangular opening (33) in the body wall of the cylinder. At the top of the horizontal portion near the edge with the vertical section, an input jack (34) for an alternating current adaptor is nestled within the cylinder beneath a square opening (35) in the body wall of the cylinder.

Wiring between the batteries, spring loaded switch, toggle switch and input jack is inside the cylinder. Two insulated wires (36) pass through a small circular opening (37) on the near side of said cylinder. Said wires extend approximately 2 inches and each attaches to a plug (38).

Figure 3:
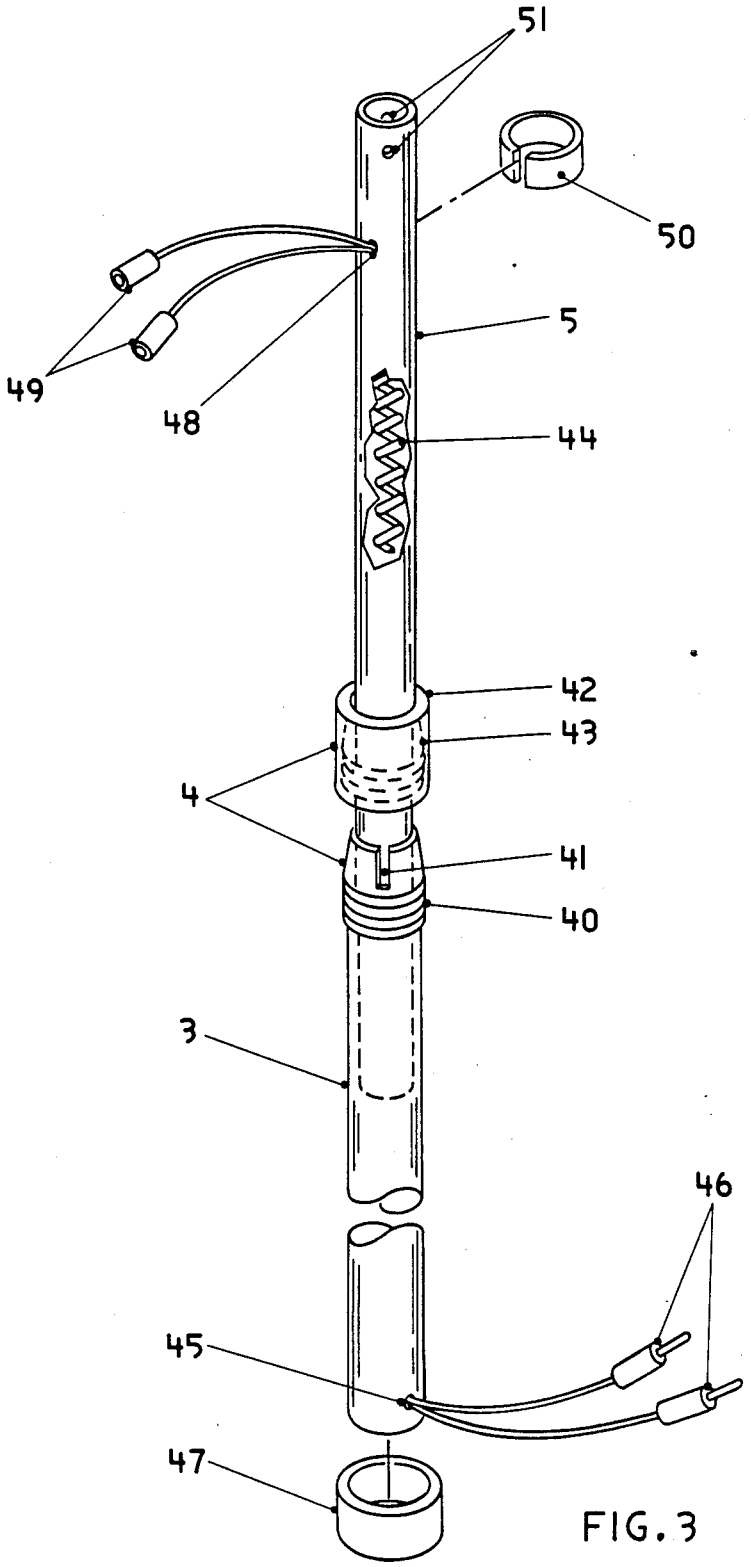
FIG. 3 is a side perspective of the extendible pole and outlining certain parts of the interior of the pole.

In reference to FIG. 3, the extendible pole is illustrated consisting of an upper pole section (5) and a lower pole section (3) with the diameter of the outer surface of said upper pole section just slightly smaller than the diameter of the inner surface of said lower pole section such that said upper pole section slides inside of said lower pole section. In the illustration, the pole sections are joined by a threaded squeeze fit coupling, shown in general as (4), in which a male section (40) with flanges (41) is permanently secured to the top of said lower pole section and a female section (42), having a tapered interior wall (43), with the smaller diameter at the top, fits loosely on said upper pole section, such that when said female section is threaded into said male section, said flanges are pressed against said upper pole section and said upper and lower pole sections are bound together. However, it should be noted that the pole sections could be connected in a variety of manners including by bolting the ends of the sections together or use of a cam type twist coupling.

The pole sections are of lightweight and sturdy construction. In the illustrative case, aluminum pole sections are used but fiberglass or plastic pole sections could also be used. Also for illustrative purposes, a two section pole is shown, but multi-section poles could be used.

Two insulated, stranded wires (44) pass through the interior hollow of said upper pole section, said coupling and said lower pole section. Approximately ½ inch from the bottom, said two pole wires pass through a small hole (45) in one wall of said lower pole section to the outside of said pole. Jacks (46) are connected to the end of each wire. A plastic cap (47) fits on the bottom of the lower pole section over said hole and said two wires such that the hole is covered and the wires extend out from under the cap and such that the bottom of the lower pole section is covered.

Approximately 2 inches from the top of the upper pole section said two pole wires pass from the interior of the pole through a small hole (48) in one wall of said pole section to the outside. Plugs (49) are attached to each wire. A plastic ring clip (50) is placed over said upper hole and over said wires after the pole is adjusted to the proper height. Said two pole wires are long enough to reach the length of the pole plus approximately 18 inches when the pole is fully extended. Said pole wires will coil within the pole when the pole sections are telescoped to shorter lengths. A hole (51) is drilled through both walls of the upper pole section ½ inches below the top end of the pole. Said hole is used when connecting the crossarm to the pole.

Figure 4:
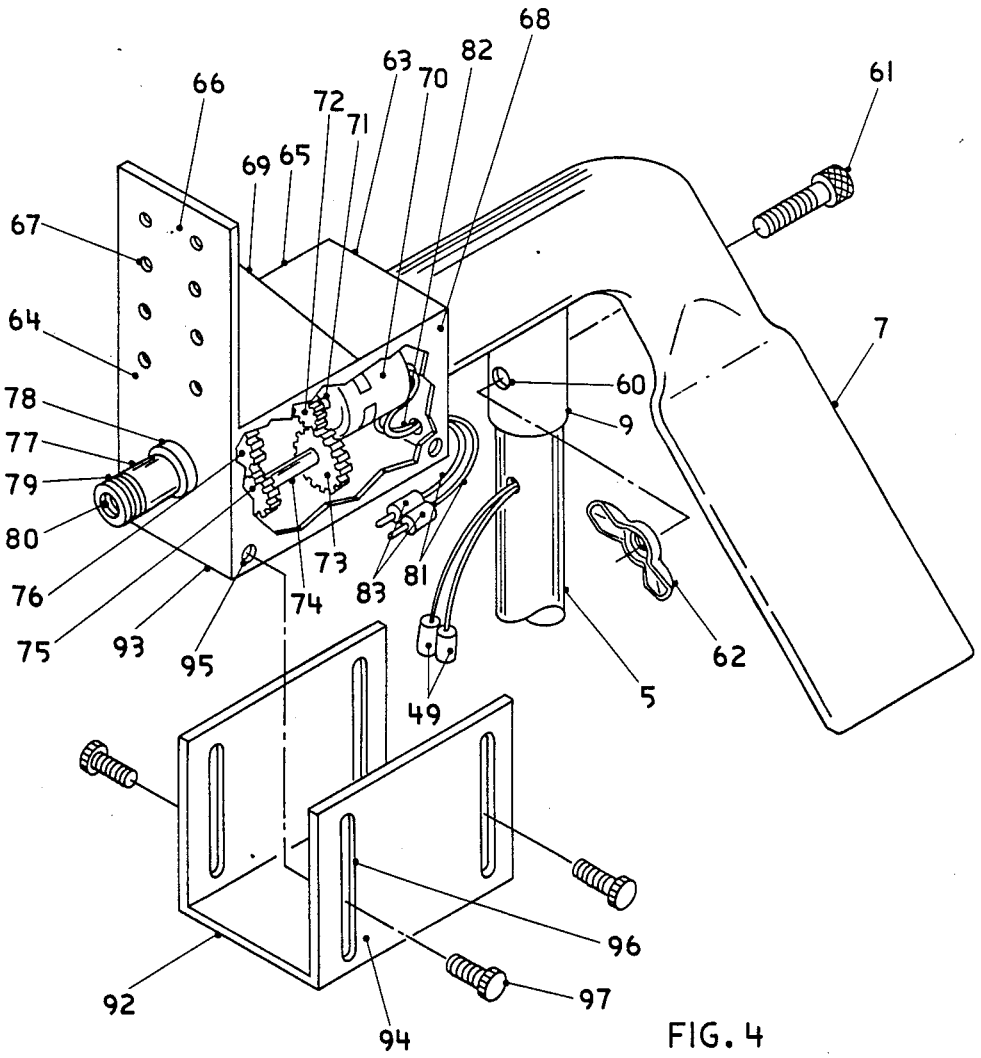
FIG. 4 is a side perspective of the crossarm showing the connector to the pole, the dislodge blade, the housing, the guide and outlining certain parts in the interior of the housing.

In reference to FIG. 4 the crossarm is illustrated said crossarm being generally tubular in cross section and manufactured from thermoplastic. A thin-walled, cylindrical connector (9) extends approximately 1 inch perpendicularly from the bottom of the horizontal portion of said crossarm. Said connector is of an inside radius slightly larger than the radius of the upper pole section (5) such that said upper pole section fits snugly into said connector. Drilled holes (60) pass through the walls of said connector with said holes being parallel to the horizontal portion of said crossarm and lining up with the holes (51) drilled through the walls of the upper pole section approximately ½ inch from the top. A thumbscrew (61) and wingnut (62) fasten said upper pole section to said connector.

On the right side of said connector the crossarm extends horizontally for approximately 1 ½ inches then bends downward 70 degrees, extends approximately 2 inches, then abruptly flattens from its tubular shape to become a flat rectangular plate called the dislodge blade (7). Said dislodge blade is sized approximately 5 inches long, ¼ inches thick and 2 inches wide. The plane containing the flat portion of the dislodge blade is the same plane formed by the horizontal centerline of the crossarm and the vertical centerline of the extendible pole.

At the left side of said connector, the crossarm extends horizontally approximately 3 inches then is joined to the center area of the back panel (63) of the housing. Said housing measures approximately 4 inches long, 2 inches wide and 2 inches high. The front panel (64) of said housing extends upwards approximately 4 inches above the top panel (65). Said extended portion (66) of the front panel has a matrix of holes (67) arranged in 4 rows of 2 columns with said rows parallel to the top panel and said columns perpendicular to said top panel. Each side panel (68) extends upward in the front to form a right triangularly shaped buttress (69) with the side edges of said upper part of the front panel with the hypotenuses of the triangles extending from approximately 1 inch below the top edge of said upper portion of the front panel to the midpoints of the top edges of said side panels.

In the interior of said housing, a permanent magnet direct current electric motor (70) is positioned with the motor shaft (71) driving a first pinion gear (72), which drives a first spur gear (73), which is attached by a first shaft (74) to a second pinion gear (75) which drives a second spur gear (76) attached to the front shaft (77). Said motor shaft, first shaft and front shaft extend parallel to the centerline of the horizontal section of the crossarm. Said motor, gears and shafts are nestled securely in the plastic interior framework of the housing.

Said front shaft passed through a hole (78) in the approximate center of the lower portion of the front panel of said housing and extends approximately ½ inch. Said front shaft is threaded on its outside surface from its outer tip back towards the housing approximately ⅜ inch (79). The interior of said front shaft at this same tip has been bored approximately ⅜ inch deep along the centerline (80) and the inner wall is threaded.

Two insulated wires (81) from the electric motor pass through a small opening (82) near the bottom near corner of the back panel of the housing. A jack (83) is attached to each wire which will connect to the plugs (49) attached to the pole wires which come out of the upper pole section near the top.

A seperate guide is made from a plastic sheet in a basically "U" shaped channel with the bottom section (92) approximately ¼ inch wider than and parallel to the bottom panel (93) of said housing. The sides (94) of said guide are parallel to and the same length as the side panels of said housing but 1 inch higher. Said guide fits up beneath said housing such that the bottom section of said guide can fit flush up against the bottom panel of said housing and the sides fit next to each other. A blind hole (95) is drilled and tapped near each bottom corner of the side panels of the housing. In the guide, a channel (96) is cut near each right and left edge of the sides with such channels running perpendicular to the bottom of said guide such that these channels line up with said threaded holes in the bottom corners of the sides of the housing. By means of a knurled head thumbscrew (97) passing through the channel and threading into said bottom corner holes the guide is attached to said housing and the distance between the bottom of the guide and the bottom of the housing can be adjusted by sliding said guide to the desired location and then tightening the knurled head thumbscrews.

Figure 5:
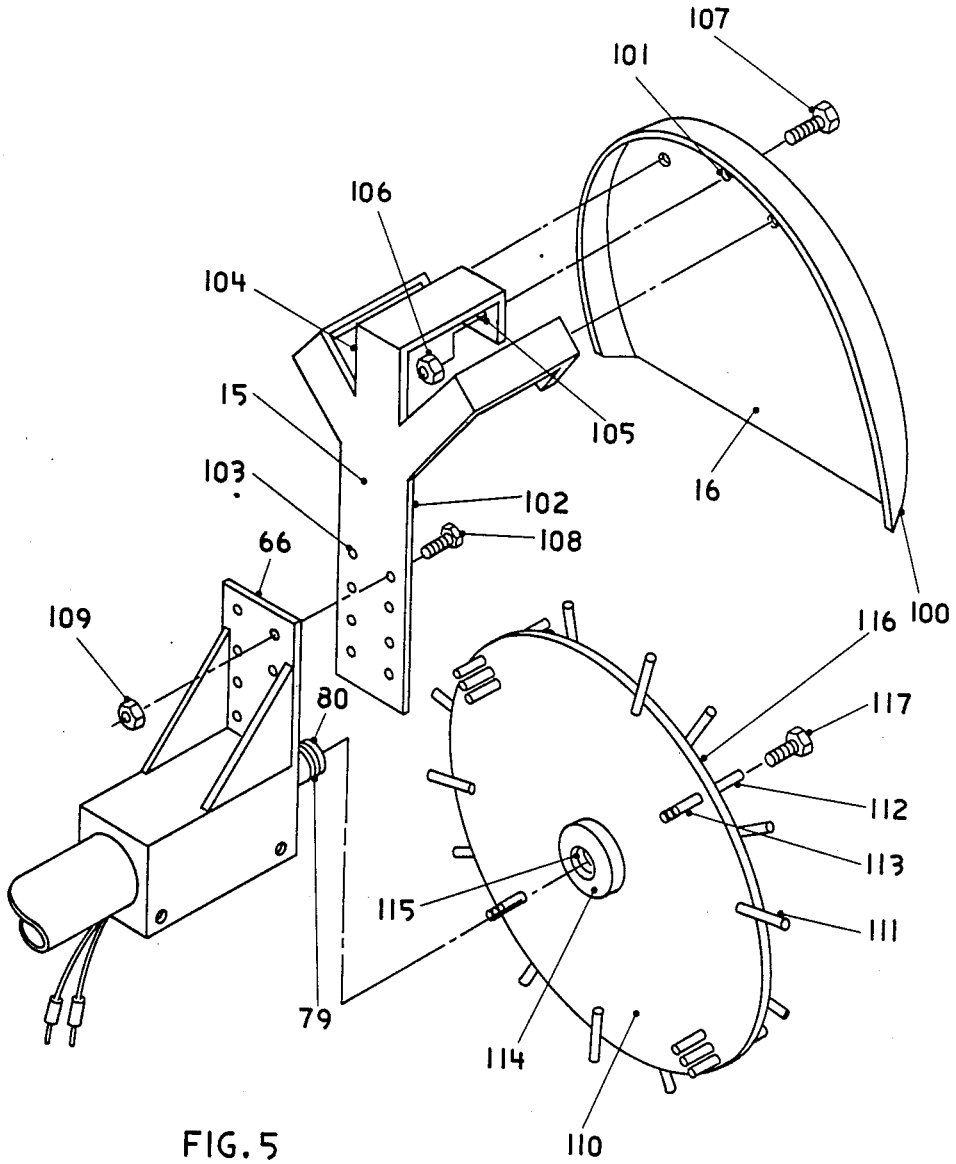
FIG. 5 is a reverse side perspective of the guard and the disk and indicating the attachment of said guard to the housing and said disk to the front shaft.

In reference to FIG. 5 the guard is illustrated consisting of a fence section (16) and a bracket (15). Said fence section is basically a flat sheet of plastic in a half circle shape with the apex at the top and the horizon at the bottom. The fence is bent inward towards the housing approximately 20 degrees, in a band (100) from the outer edge of the semicircle to approximately 2 inches in towards the mid-point. Holes (101) are drilled approximately 1 inch in from the outer edge of the half circle and at the 75, 90 and 105 degree marks respectively.

The bracket is of one piece molded thermoplastic contruction with a housing side, a top side and a fence side. The rectangular bottom portion of the housing side of the bracket (102) is of the same width as the extended upper section of the front panel of the housing (66) and contains a matrix of holes (103) arranged in 4 rows and 2 columns with said columns perpendicular to and said rows parallel to the bottom edge of said housing side of the bracket.

Said housing side of the bracket extends upward from said rectangular bottom portion in three arms (104). Each arm is approximately 1 inch wide. Said arms are in the same plane as said rectangular bottom portion for approximately 2 inches, then bend 90 degrees, then extend approximately 1 ½ inches forming the top section of the bracket, then are bent 90 degrees a second time forming the fence side of the bracket such that the bracket section appears to have roughly an inverted "U" shape if seen in cross section from the side. After said second 90 degree bend, each arm extends approximately 2 inches and is cut off square. Holes (105) are drilled at the center point of the fence side of each arm with said holes matching up with the 3 holes (101) in the fence section and said bracket and said fence are fastened with nuts (106) and bolts (107). The entire guide is then positioned so that the rectangular bottom portion of the housing side of the bracket fits flush with the outside of said extended upper portion of the front panel of the housing. The matrixes of holes are aligned to position the height of the guard relative to the housing at the desired location, bolts (108) are passed through two holes in a row of the matrixes, and the guard and the housing are joined by tightening nuts (109) to said bolts.

The disk consists of a solid, semi-rigid sheet of plastic cut into an approximately 8 inch diameter circle to form the body (110). Approximately ¼ inch below the edge of said body on the housing side and the fence side, high density polypropylene spikes (111), each approximately 4 mm in diameter and ⅝ inches long, are glued parallel to the body such that the spikes protrude from the outer edge of the body approximately 3/16 inches. Approximately every 90 degrees, 3 spikes (112) are glued on the fence side of said body and 3 spikes (113) are glued on the housing side of said body with said spikes being perpendicular to the plane of said body and in a straight line from the center of the body to the edge of said body.

At the center of the body on the housing side a cylindrically shaped plastic plate (114) approximately 1 inch in diameter and ½ inch thick is glued. Said plate is drilled (115) at its center approximately ⅜ inch deep on the housing side and tapped allowing it to be threaded onto the outside of the outer tip (79) of said front shaft with said disk being centered on said front shaft and perpendicular to said front shaft. A hole (116) is drilled through the center of the body and the center of said plate with said hole aligning with the center of said front shaft. A screw (117) is placed through said hole and is tightened into the threaded bore hole (80) in the interior of said front shaft.

What is claimed is:

1. A hand held tool for cleaning pine needles and other debris from a rain gutter by an operator standing on the ground said tool comprising:

(A) a handle consisting of a vertical tubular section adapted to fit snugly over a pole, and a horizontal section, cylindrical in shape, in which batteries, battery charger input jack, on/off switch and motor direction switch are nestled into the inner framework of said horizontal section, (B) a pole consisting of an upper and lower section joined by a threaded squeeze fit coupling, (C) a crossarm which is basically tubular in cross section containing a cylindrical connector perpendicular to said crossarm such that said pole can be attached to said connector by means of a thumbscrew and wingnut with said crossarm and pole forming a "T" shape when seen in cross section, (D) said crossarm at a point near one end bending approximately 70 degrees towards the ground and, a few inches after said bend, being molded from its tubular shape to a flat rectangularly shaped dislodge blade, (E) said crossarm at the opposite end to said dislodge blade being molded into a housing which contains an electric motor, gears and shafts nestled in the internal framework of said housing, (F) said housing being roughly boxlike in shape with a front panel extending upward above a top panel of said housing approximately 4 inches and with front portions of two side panels extending upward to form a right triangularly shaped buttress with an upper part of the front panel, (G) said housing had threaded holes in bottom cornors of the left and right sides to which a roughly "U" shaped sheet of plastic forming bottom and side portions is bolted with such sheet forming a guide and having its bottom portion parallel to the bottom panel of the housing, (H) a motor shaft extending from said housing and being threaded on its outer surface at its tip and is bored and threaded at this same tip such that a disk can be attached to said shaft, (I) a disk mounted on said shaft and comprised of a semi-rigid plastic body from which semi-rigid plsatic spikes protrude both parallel to and perpendicular to said body, (J) a guard comprising a half-circle shaped fence section parallel to the disk and a bracket section which in cross section is shaped like a roughly inverted "U" with one leg cut short and a second longer leg attached to the upper part of the front panel of the housing and the shorter leg attaching to the fence section with the top half of the disk fitting between the longer leg and the fence section, (K) two wires located in the interior of the pole which connect the electric motor and the circuitry in the pole handle.

2. A rain gutter cleaning tool according to claim 1 wherein said guide is adjustable in the spacing between the bottom portion of the guide and the bottom of the housing.

3. A rain gutter cleaning tool according to claim 1 wherein the electric motor can be controlled from the handle to be turned on or off and to be rotated clockwise or counterclockwise.

4. A rain gutter cleaning tool according to claim 1 wherein the height of the pole can be adjusted.

5. A rain gutter cleaning tool according to claim 1 wherein the invention is manufactured from lightweight materials and which utilizes thermoplastic materials wherever the apparatus is in contact with the surface of the rain gutter.

6. A rain gutter cleaning tool according to claim 1 which is readily disassembled for easy shipment and storage.

* * * * *